United States Patent [19]

Berney

[11] 4,320,476

[45] Mar. 16, 1982

[54] ELECTRONIC WATCH WITH A DEVICE FOR CONTROLLING AND DRIVING THE DAY OF THE MONTH

[75] Inventor: Jean-Claude Berney, Epalinges, Switzerland

[73] Assignee: Jean-Claude Berney SA, Epalinges, Switzerland

[21] Appl. No.: 52,749

[22] Filed: Jun. 28, 1979

[30] Foreign Application Priority Data

Jul. 10, 1978 [CH] Switzerland ..... 7455/78

[51] Int. Cl.[3] ..... G04B 19/24

[52] U.S. Cl. ..... 368/28; 368/34; 368/35; 368/37; 368/38

[58] Field of Search ..... 58/58, 4 A; 368/28, 368/34, 35, 37, 38

[56] References Cited

U.S. PATENT DOCUMENTS

| | | | |
|---|---|---|---|
| 3,827,234 | 8/1974 | Imanishi | 58/58 |
| 4,060,976 | 12/1977 | Jakob | 58/58 |
| 4,175,372 | 11/1979 | Tamara et al. | 368/28 X |

OTHER PUBLICATIONS

Brice Ward, *Digital Electronics*, Tab Books, Blue Ridge, Summit, Pa. 17214, 1972, p. 17.

*Primary Examiner*—Ulysses Weldon

*Attorney, Agent, or Firm*—Wender, Murase & White

[57] ABSTRACT

An electronic watch comprising a device for controlling and driving the day of the month disc, wherein the wheel train supplies the energy necessary for moving the day of the month disc, but does not determine the instant of the jump, which may be initiated at any moment by an electrical signal, independently of the position of the wheel train.

The device comprises a mechanism driven by the wheel train and arranged so as to disengage when the moving bodies of the wheel train, controlling the display, turn continuously in clockwise direction and to re-engage when said moving bodies turn in anti-clockwise direction. A control circuit determines, in a portion of the driving cycle in an anti-clockwise direction of rotation with a rapid rate, the jump of the display disc of the day of the month mechanism.

9 Claims, 4 Drawing Figures

ELECTRONIC WATCH WITH A DEVICE FOR CONTROLLING AND DRIVING THE DAY OF THE MONTH

BACKGROUND OF THE INVENTION

The present invention relates to an electronic watch comprising means for counting time, an analog display controlled by a bidirectional stepping motor and a control and driving device for a day of the month disc mechanism.

In known analog quartz watches, the day of the month disc for displaying the date is driven by the wheel train which also drives the hands for displaying the time. This movement is effected by means of a mechanism which, on the one hand, determines the moment at which the jump of the disc must take place as a function of a specific position of the wheel train and, consequently, of the hands and, on the other hand, transmits the energy which is necessary for this jump. The object of the present invention is to provide a control and driving device of the day of the month in which the wheel train still provides the energy but does no longer determine the moment of the jump, this jump being capable of being inititated at any moment by an electrical signal, independently of the position of the wheel train. Such a device is particularly useful in certain types of analogic quartz watches and for obtaining perpetual or semi-perpetual day of the month calendars.

SUMMARY OF THE INVENTION

According to the present invention there is provided an electronic watch having time counting means, an analog display controlled by a bidirectional stepping motor driving, by means of a wheel train, hands for displaying the time, comprising: means for counting the driving pulses, a day of the month mechanism driven by the wheel train and arranged so as to disengage when the moving bodies of the wheel train controlling the display turn continuously in clockwise direction and to re-engage when said moving bodies turn in anti-clockwise direction; and a control circuit for the day of the month driving mechanism, connected at least indirectly to the control circuit of the motor and to the counting means of the driving pulses and arranged so as to impose a rapid driving rate and an anti-clockwise direction of rotation of said moving bodies during at least part of a driving cycle of the day of the month mechanism, the start of a driving cycle being initiated by an electrical signal delivered to said control circuit and the end of said cycle being determined by an electrical signal delivered by the counting means of the driving pulses when said moving bodies have resumed a position corresponding to the correct time display.

BRIEF DESCRIPTION OF THE DRAWINGS

The present invention will now be described, by way of example, with reference to the accompanying drawings, in which.

DESCRIPTION OF THE PREFERRED EMBODIMENTS

Figure 1:
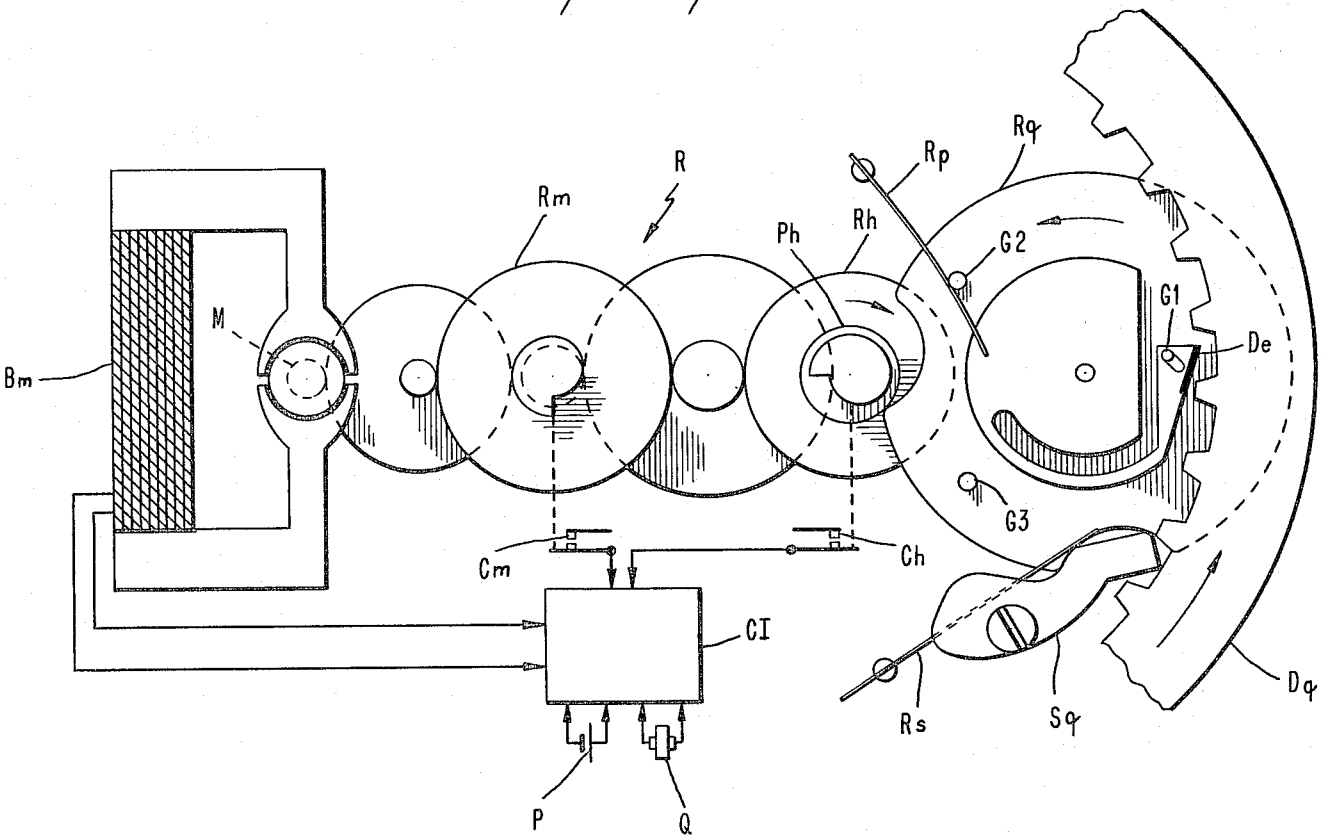
FIG. 1 shows schematically various parts of a watch mechanism.

FIG. 1 shows a quartz resonator Q and an electric supply source P connected to inputs of an integrated circuit CI, also connected to the coil Bm of the motor. This motor, shows very schematically, is of the single-phase bidirectional type. Of course, any type of single or multi-phase bidirectional motor may be used; such motors have already been specified by various manufacturers. This motor drives, by means of a pinion, the wheel train R actuating the hands (not shown), comprising, among other things, a minute wheel Rm and an hour wheel Rh. Obviously, in practice, these two wheels are superimposed and the minute and hour hands turn about the same axis. The minute wheel Rm drives a cam which actuates a contact Cm which closes when the minute hand passes through O. The hour wheel Rh drives a cam which actuates a contact Ch which closes when the hour hand passes through O. The purpose of these two contacts Cm and Ch will be explained in the description of FIG. 3. In this embodiment, the minute hand is displaced by one unit with each step of the motor.

The mechanism of the day of the month comprises a wheel Rq which meshes with the pinion Ph rigidly connected to the hour wheel Rh. This wheel Rq has a portion of its circumference, over which it disengages from the pinion Ph. The wheel Rq carries a finger De adapted to drive the day of the month disc Dq which is, in this particular case, a cut-out part having a flexible arm. The finger De is maintained in its position by the pin G1, with some degree of freedom, allowing the finger De to pass over the teeth of the day of the month disc Dq. The latter is maintained in its position by a jumper Sq which itself is subjected to the action of a spring Rs. The wheel Rq is returned to position by the return spring Rp acting on the pins G2 and G3, and the jumper Sq is of such a shape that the disc Dq cannot move back. When the hour wheel Rh turns in the clockwise direction (normal mode of operation), the wheel Rq moves into the position shown in FIG. 1. The pinion Ph reaches the limit of the disengagement zone of the wheel Rq which is held against the pinion by the return spring Rp acting on the pin G2. The day of the month mechanism is disengaged as long as the hour wheel Rh turns in the clockwise direction.

Figure 2:
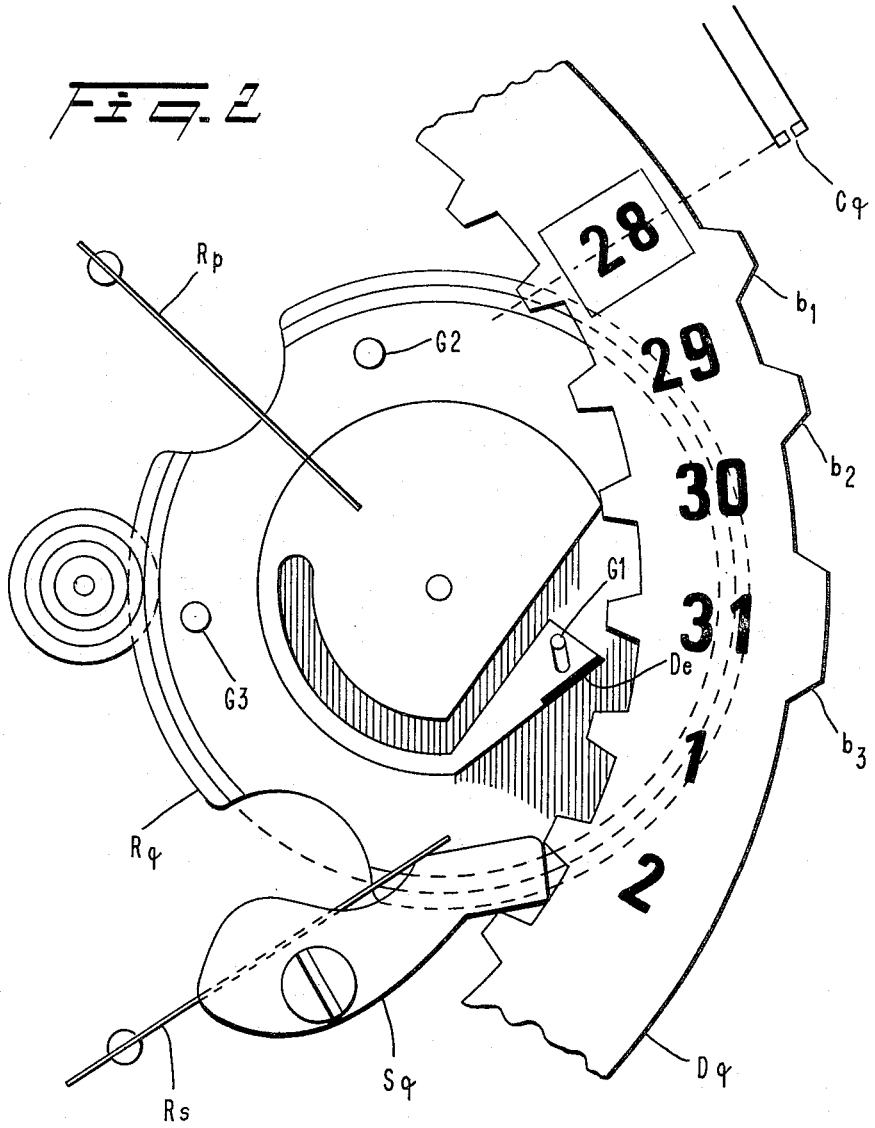
FIG. 2 shows schematically a day of the month mechanism for the watch according to the present invention.
Figure 2A:
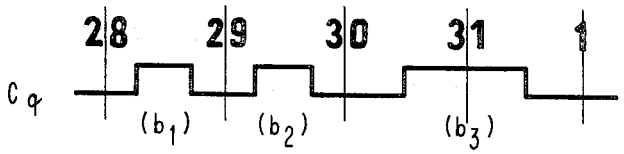
FIG. 2*a* is a diagram of the operation of the contact controlled by the day of the month disc.
Figure 3:
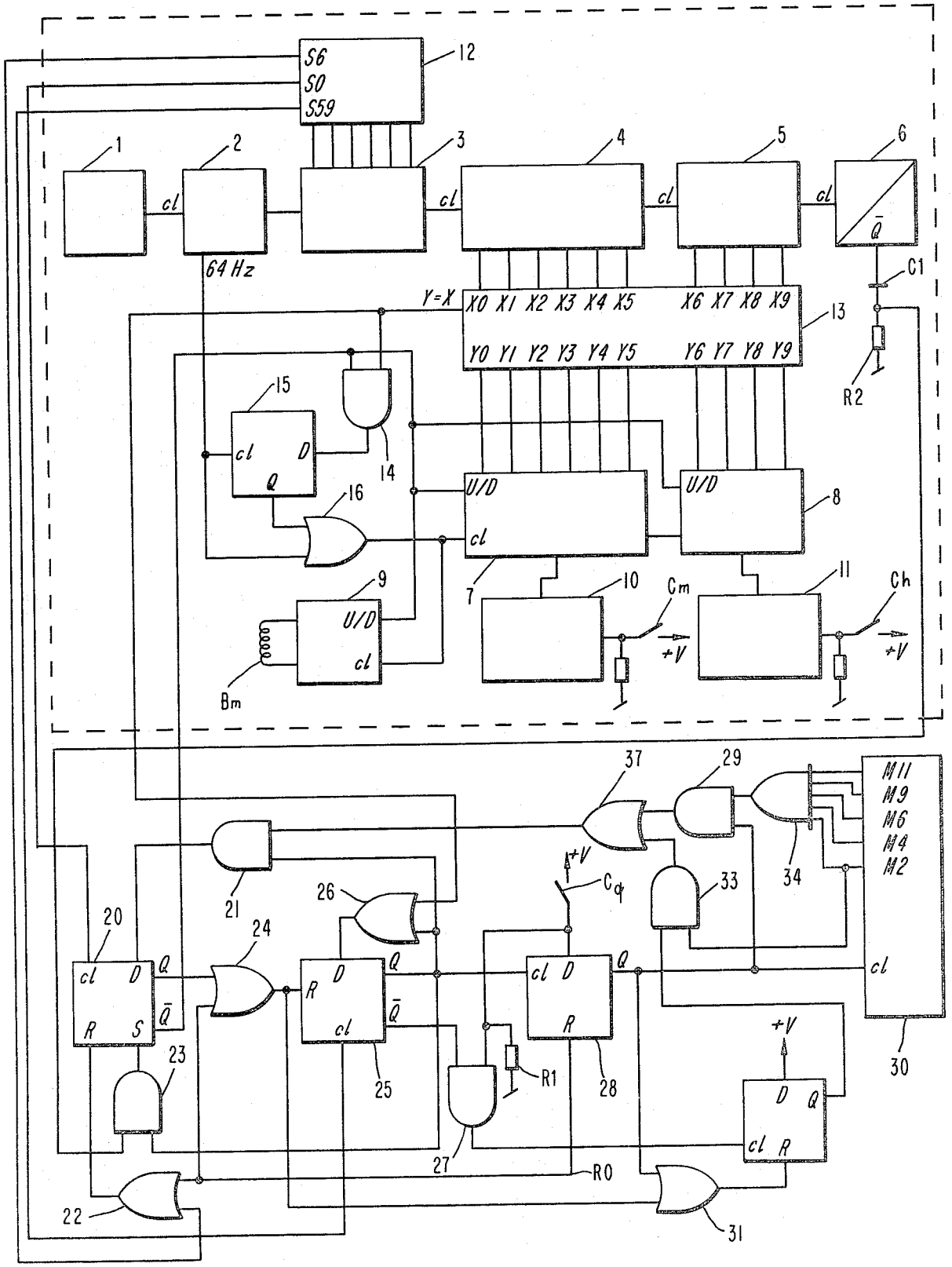
FIG. 3 shows a block diagram of the electronic circuit of a watch according to the present invention.

In order to engage the day of the month mechanism, it is therefore necessary for the hour wheel Rh to turn in an anticlockwise direction, as shown in FIG. 2. In this case, the wheel Rq, held against the pinion Ph by the spring Rp, returns to the driving zone and is displaced. The day of the month disc Dq, maintained by the jumper Sq, cannot move back and the finger De jumps one tooth. At the end of six turns of the minute wheel Rm, it is in the position shown in FIG. 2. If, at this moment, rotation is re-established in the clockwise direction and the position shown in FIG. 1 is resumed so as to re-establish the correct time display, the finger De pushes the tooth of the day of the month disc Dq. The latter, while being displaced, raises the jumper Sq which passes behind the next tooth. The day of the month disc jumps by one step. The finger De and the wheel Rq stop again when the wheel Rq reaches the disengaging zone, whereas the day of the month disc Dq is displaced again by a certain amount under the action of the jumper Sq until the latter has found again its rest position. Hence, even if the disc Dq jumps whilst the hour wheel Rh turns in clockwise direction, it is necessary for this wheel to turn previously for some time in the anticlockwise direction in order to re-engage the day of the month mechanism. In FIG. 2, the disc Dq has special extensions which actuate the contact Cq. The sequence of this contact is shown in FIG. 2*a*. This contact closes, on the one hand, when the day of the month disc Dq is in position 31 tooth b3, and, on the other hand, when this disc passes from position 28 to position 29 (tooth b1), and when it passes from position 29 (tooth b1) to position 30 (tooth b3). The other two functions shown concern the diagram of FIG. 3. The upper part of the diagram of FIG. 3 shows the main components of the circuit of a special watch already forming the subject of a specification (see Swiss Application No. 11765/77). We shall therefore only give a brief description as a reminder. The device according to the invention is particularly useful for this type of watch. A control circuit for this device is shown in the lower part of the diagram.

The oscillator 1, the divider 2, the seconds counter 3, having a capacity of 60, the minutes counter 4, having a capacity of 60, the hours counter 5 having a capacity of 12 and the flip-flop FF6 forming a divide by two counter, are connected in cascade and form a time-counting chain having a capacity of 24 hours.

The bidirectional divide by sixty counter 7, the clock and up/down control inputs U/D of which are connected to the corresponding inputs of the control circuit of the motor 9, and the bidirectional divide by twelve counter 8, connected in cascade, form a counting chain of the driving pulses of a capacity of 720 motor steps, which correspond to a complete turn of the dial by the hour hand. The detail of the control circuit of the motor 9 is not given, since it depends on the type of motor employed, but it will be assumed that it delivers forward driving pulses at the watch frequency when its input U/D is at 1, and backward driving pulses when this input U/D is at 0. The counter 7 is returned to zero by the contact Cm, via the pulse shaping circuit 10, at the moment the minute hand passes through 0, and the counter 8 is returned to 0 through the contact Ch by means of the pulse shaping circuit 11, at the moment the hourhand passes through 0. The counters 7 and 8 are therefore respectively synchronous with the minute and hour hands and the states thereof correspond to the respective positions of these hands on the dial. The seconds counter 3 delivers a parallel binary information of six bits, corresponding to its state to the inputs of the decoder 12. The decoder 12 is arranged so as to deliver signals to the outputs S0, S6 and S59 respectively at the seconds 00, 06 and 59 of the same minute.

The minutes counter 4 and the hours counter 5 deliver a parallel binary information of 6 and 4 bits respectively, corresponding to their states, to the inputs Xo to X9 of a comparator 13. The bidirectional counters 7 and 8 deliver a parallel binary information of 6 and 4 bits respectively, corresponding to their states, to the inputs Y0 to Y9 of the comparator 13. The comparator 13 sends a signal 1 to its parity output when Y=X. This output is connected to an input of the AND gate 14, the output of which is connected to the D input of a D-type flip-flop FF 15, the Q output of which is connected to an input of the OR gate 16. The second input of the OR gate 16 is connected to the clock input of the FF 15 and to a 64 Hz output of the divider 2.

Let us assume that the second input of the AND gate 14, and the inputs U/D of the control circuit 9 and of the counters 7 and 8 are at 1. When Y=X the D input of the FF 15 is at 1 as is its Q output, thus maintaining the output of gate 16 at 1. The control circuit of the motor as well as the counter 7 receive no clock pulses. The motor is stopped and the minute and hour hands occupy positions on the dial corresponding to the contents of the time counters 4 and 5.

If, on the contrary, Y is not equal to X, the parity output (Y=X) of the comparator 13 passes to 0 as does the Q output of FF 15. The OR gate 16 allows the 64 Hz singals to pass to the clock inputs of the control circuit 9 and of the counter 7, the inputs U/D of which are at 1. The motor and the counter 7 advance at 64 steps per second until the moment when equality is re-established, that is to say at the moment where Y=X, for which condition the motor is blocked again.

Hence, in normal operation, the counter 4 advances by one step per minute. The OR gate 16 allows a signal to pass which advances the motor and the counter 7 by one step, thus reestablishing equality and again blocking pulses from passing through the gate 16. The minute hand has advanced by one step and occupies on the dial a position corresponding to the new value of Y. Thus the minute hand advances by one step per minute.

Let us turn now to the description of the control circuit driving the day of the month disc proper.

The circuit comprises a first D-type flip-flop FF 20, in which the clock input is connected to the output So of the decoder 12, the D input is connected to the output of an AND gate 21, the return-to-zero input is connected to the output of an OR 22, the set input is connected to the output of the AND gate 23, the Q output is connected to an input of the OR gate 24, and the $\overline{Q}$ output is connected to the second input of the AND gate 14 and to the inputs U/D of the counters 7 and 8 and of the control circuit of the motor 9. The output S6 of the decoder 12 is connected to an input of the OR gate 22, and the output S59 is connected to the clock input of a second D type flip-flop FF 25, in which the return-to-zero input is connected to the output of the OR gate 24, the D input is connected to the output of an OR gate 26, the $\overline{Q}$ output is connected to an input of the AND gate 27 and the Q output is connected to the second input of the AND gate 23, to an input of the OR gate 26, to an input of the AND gate 21 and to the clock input of a third D-type flip-flop FF 28. The return-to-zero input of this FF 28 is connected to a general return-to-zero terminal Ro, also connected to the second input of the OR gate 22 and to the second input of the OR gate 24. The D input of FF 28 is connected to the second input of the AND gate 27 and to the contact Cq, the potential of which is earthed via the resistor R1, and its Q output is connected to an input of the AND gate 29, to the clock input of a months counter 30 and to an input of the OR gate 31, the second input of which is connected to the output of the OR gate 24. The output of the OR gate 31 is connected to the return-to-zero input of a fourth D type flip-flop FF 32, the clock input of which is connected to the output of the AND gate 27, the D input to the positive feed line and the Q output to an input of the AND gate 33. The months counter 30 is a divide by twelve counter, for example of Johnson type. The outputs M2, M4, M6, M9 and M11 of this counter 30, corresponding to the months of February, April, June, September and November, are connected to the inputs of an OR gate 34, the output of which is connected to the second input of the AND gate 29. The outputs of the AND gates 29 and 33 are connected to the inputs of an OR gate 37, the output of which is connected to the second input of the AND gate 21. The second input of the AND gate 33 is connected to the output M2, corresponding to the month of February, of the months counter 30. Finally, the second input of the OR gate 26 is connected to the parity output of the comparator 13, and the first input of the AND gate 23 is connected via a capacitor C1 and a resistor R2 forming a shunt circuit to the $\overline{Q}$ output of FF 6.

Operation is as follows. Assuming the input Ro is at 0, the contact Cq is open and that the D type flip-flops change over on the positive going edge of a clock pulse and the counter 30 on the negative going edge of this clock pulse. At the start, the FF 20, 28 and 32 are at 0 and the FF 25 is at 1. The $\overline{Q}$ output of FF 20 is at 1 and consequently also the second input of the AND gate 14 and the U/D inputs of circuits 7, 8 and 9. The watch operates normally by minute jumps as already stated above. Every twenty-four hours, at midnight, the time counter, consisting of counters 3, 4, 5 and 6 passes to 0. the $\overline{Q}$ output of FF 6 passes to 1 and delivers a positive going pulse to the first input of the AND gate 23, the second input of which, connected to the Q output of FF 25, is at 1. The pulse then passes to the set input S of FF 20 and causes it to change to state 1. The $\overline{Q}$ output passes to 0, likewise the U/D inputs of the circuits 7, 8 and 9, the output of the AND gate 14 and finally the Q output of FF 15. The OR gate 16 allows the 64 Hz signal to pass to the clock inputs of the counter 7 and of the control circuit 9, both controlled for down-counting. The motor and the hands are displaced backwardly at the rate of 64 steps per second, the effect of which is to engage the mechanism of the day of the month described with reference to FIG. 1. The Q output of FF 20 simultaneously passes to 1, thus putting the FF 25 at 0 through the OR gate 24. The Q output of FF 25 is then at 0, thus blocking the AND gates 21 and 23.

The changeover at midnight takes place at an entire minute, that is to say, when the decoder 12 delivers a signal to its output So. Six seconds later, it delivers a signal to its output S6. This signal passes through the OR gate 22 and effects the return-to-zero of FF 20, the Q output of which passes to 0, as does the return-to-zero input of FF 25, and the $\overline{Q}$ output of FF 20 which having passed to 1, unblocks the AND gate 14 and controls the circuits 7,8 and 9 for forward operation again. During these six seconds, the motor and the counter 7 have effected $6\times64=384$ steps backwards, which correspond to about 6 turns of the minute hand. The hands have therefore left the positions corresponding to the contents of the counters 4 and 5 and Y is obviously no longer equal to X. The parity output of the comparator 13 is therefore at 0.

The output of the AND gate 14 and the Q output of FF 15 therefore remain at 0, and the gate 16 continues to allow the 64 Hz signals to pass to the clock inputs of the circuits 7 and 9 which are now controlled for forward operation. The motor and the hands now advance at the rate of 64 steps per second whilst driving the day of the month disc. After about six seconds this disc has jumped one step; the mechanism is again in the disengaging zone and the hands once again reach their previous positions corresponding to the contents of the counters 4 and 5. As soon as Y=X, the parity output of the comparator 13 passes to 1, as does the output of the AND gate 14 and the Q output of FF 15, thus maintaining the output of the gate 16 at 1. The motor and the hands stop and the watch resumes normal operation after having executed six backward turns, then six forward turns, thus causing the day of the month disc to advance by one step.

At the 59th second of the same minute, the decoder 12 delivers a signal to its output S59, which signal causes the FF 25 to change state, the D input of which is maintained at 1 by the parity output of the comparator 13 via the OR gate 26. This FF 25 then changes state to 1, thus maintaining the output of the gate 26 at 1 and unblocking the gate 21. FF 25 can return to the state 0 only if FF 20 returns to 1, either under the action of a new 24 hour pulse, delivered at its set input by FF 6 or, if its D input is at 1, under the action of the signal delivered by the decoder 12 to its output So, to the second 00 of each minute. Three cases may arise:

(1) During the driving cycle, contact Cq has remained constantly open. The FF 28 and 32 have therefore remained at 0, which keeps the outputs of the gates 29 and 33 at 0 and consequently the outputs of the gates 37 and 21. The D input of FF 20 is at 0, and the latter can change to 1 only under the action of the 24 hour pulses. The day of the month disc has effected a single jump and will only effect the next one 24 hours later.

(2) During the driving cycle, contact Cq closes (tooth b3) and remains closed at the end of this cycle (31st day of the month). During the cycle, the $\overline{Q}$ output of FF 25 is at 1, thus unblocking the AND gate 27. When Cq closes, the output of AND gate 27 passes to 1, thus changing over FF 32, the Q output of which passes to 1. At the end of the cycle, i.e. at the 59th second of the minute, the Q output of FF 25 returns to 1. As Cq is still closed, the D input of FF 28 is at 1 and the latter, receiving the signal from the Q output of FF 25, passes to 1, thus effecting the return-to-zero of FF 32 via the OR gate 31. The AND gate 33 remains blocked, whilst the AND gate 29 is unblocked and will deliver a signal 1 when the output of the OR gate 34 is at 1, i.e. when the months counter is at 2, 4, 6, 9 or 11, positions corresponding to the months of February, April, June, September or November. If this is the case, the outputs of the gates 37 and 21 pass to 1, as does the D input of FF 20.

The FF 20 therefore changes state again to 1 during the next second 00, directly following the 59th second. This causes the engagement of a new complete driving cycle, of the day of the month. During this cycle the disc therefor passes from position 31 to position 1, in which position the contact Cq is open. At the end of the cycle, i.e. at the 59th second, FF 28 then returns to 0, the same as the outputs of the gates 29, 37 and 21 as well as the D input of FF 20, which will be able to return to state 1 only on the next 24 hour pulse. Hence, by means of the contact Cq, of FF 28 and of the counter 30, unstable positions are created for which the control circuit driving the day of the month disc automatically reengages to cause the disc to pass to the following position. These positions are 31st February, 31st April, 31st June, 31st September and 31st November.

(3) During the driving cycle, contact Cq is closed (tooth b1, b2) but is opened again at the end of this cycle (passage from 28 to 29 and from 29 to 30). During the cycle, the $\overline{Q}$ output of FF 25 is at 1, thus unblocking the AND gate 27. When Cq closes during the driving of the day of the month disc for forward operation, FF 20 being at 0, the output of the AND gate 27 passes to 1, thus causing FF 32 to change state, the Q output of which passes to 1. At the end of the cycle, i.e. at the 59th second of the minute, Cq is again opened and FF 28 remains at zero. The AND gate 29 remains blocked whilst, with FF 32 remaining at 1, the AND gate 33 opens and delivers a signal 1 if the output M2 of the counter 30 is at 1, which corresponds to the month of February. The outputs of the gates 37 and 21 and consequently the D input of FF 20 are at 1, and the latter returns to 1 during the next second 00, thus returning FF 32 to 0 and starting a new driving cycle of the day of the month during which the disc jumps by one step. Hence, by means of the contact Cq, of FF 32 and of the counter 30, new unstable positions are created for which the control circuit driving the day of the month disc automatically re-engages for passing the day of the month disc to the next position. These positions are 29th and 30th February. Therefore, for example, when the day of the month passes from the 28th to 29th February, FF 32 gives the condition 29 of the second month with corresponds to an unstable position, thus starting a second driving cycle. The day of the month passes from the 29th to the 30th February and FF 32 again gives the condition 30 of the second month which corresponds to an unstable position, thus starting a third driving cycle. The day of the month passes from the 30th to the 31st February. This time it is FF 28 which gives the condition 31 of the second month as an unstable position, thus starting a fourth driving cycle. The day of the month passes from 31st February to the 1st of March, a stable position and remains there until the next 24 hour pulse delivered by the time counter. Thus a perpetual or semi-perpetual day of the month is obtained. Of course, it is possible to use another sequence of contact Cq, or to use several contacts actuated by the day of the month disc, which would be a needless complication. By means of contact Cq it is also possible to synchronize an inner day counter, the state of which would represent the position of the day of the month disc.

On the other hand, in our example, the control circuit of the day of the month causes the minute hand to execute six turns backwards and six turns forwards, corresponding to the control mechanism of the day of the month which we have taken as an example. Of course, it is possible to provide day of the month mechanisms necessitating 12 backward turns, or 14 backward turns and two forward turns, etc. etc. In every case, the start of backward operation during at least part of the driving cycle must represent an absolute condition for producing the jump of the day of the month disc.

It is obvious that it is also possible to employ a device according to the present invention in a watch having a second hand. Then, the control circuit will cause the second hand to execute a plurality of backward turns and then forward turns, the day of the month mechanism being no longer engaged at the level of the hour wheel, but for example at the level of an intermediate wheel between the seconds wheel and the minute wheel, or at the level of the minute wheel.

We claim:

1. An electronic watch comprising:

means for generating two trains of time base pulses having different first and second frequencies;

means for counting said first frequency time base pulses;

a bi-directional stepping motor;

motor control means receiving said second frequency time base pulses for generating driving pulses, said motor control means being connected to said motor for control thereof;

means for counting said driving pulses;

an analog display for displaying the time;

a wheel train including a plurality of moving bodies connected to said analog time display and permanently connected to said stepping motor for displaying the time;

a display disc for displaying the day of the months;

a day of the month mechanism coupled to said wheel train for controlling the driving of said display disc, said mechansim disengaging from said wheel train when said moving bodies turn continuously in a clockwise direction and engaging with said wheel train but not acting on said display disc when said moving bodies turn in an anti-clockwise direction;

means for generating a first electrical signal when the position of the display disc is to be modified, said first signal initiating a two part cycle for driving said display disc; and a control circuit connected to said motor control means, said first frequency time base pulse counting means, said driving pulse counting means and said means for generating said first electrical signal for imposing in response to said first electrical signal a rapid drive rate in an anti-clockwise direction of rotation upon said moving bodies during a first part of said driving cycle to engage said wheel train with said day of the month mechanism and for imposing a rapid drive rate in a continuous clockwise direction of rotation to said moving bodies during a second part of said driving cycle to disengage said wheel train from said day of the month mechanism, said driving cycle being ended by a second electrical signal generated by said control circuit when said first frequency time base pulse counting means and said driving pulse counting means detect said moving bodies have resumed a position corresponding to a display of the correct time by said analog display.

2. An electronic watch according to claim 1, further comprising:

means for detecting the position of said display disc and delivering a first detecting signal when said display disc occupies one given position and a second detecting signal when said display disc passes between two predetermined adjacent positions, and a months counter incremented in response to said first detecting signal and delivering on its outputs a signal representative of the number of days in each month, said control circuit further comprising means responsive to said first and second detecting signals and to the output of said counter for initiating at the end of a driving cycle at least one additional driving cycle for driving said display disc to a position displaying the day of the month counted in said months counter.

3. A watch according to claim 2, wherein said first electrical signal is a 24-hour pulse delivered by said first frequency time base pulse counting means, and said control circuit comprises a flip-flop and logic circuits including at least one memory means, said flip-flop receiving said 24-hour pulse for controlling rapid backward operation of said motor and of said driving pulse counting means, said flip-flop being returned to zero by a pulse delivered by said first frequency time base pulse counting means a predetermined time after said 24-hour pulse for controlling rapid forward motion of said motor until said analog display again displays the correct time, said flip-flop being further controlled at the end of said driving cycle by said detecting signals, said detecting signals acting on said flip-flop by means of said logic circuits for initiating at least one additional driving cycle if said detecting means have delivered one of said detecting signals during or at the end of said driving cycle.

4. A watch according to claim 2, wherein said detection means comprise a contract actuated by the display disc.

5. A watch according to claim 2, wherein said detection means comprise a contact actuated by a plurality of extensions located on said display disc.

6. A watch according to claim 2, wherein said day of the month mechanism comprises a wheel engaging a pinion rigidly connected to one of said moving bodies and disengageable over a portion of the circumference of said wheel, said wheel being maintained by a return spring acting on a pin at the limit of said disengaged portion, so that said day of the month mechanism engages when said moving body turns in an anticlockwise direction and disengages when said moving body turns continuously in a clockwise direction.

7. A watch according to claim 2, wherein the rotation in an anti-clockwise direction to engage said day of the month mechanism is followed by a rotation at a rapid rate in a clockwise direction to reestablish display of the correct time.

8. A watch according to claim 6, wherein the anti-clockwise rotation for engaging the mechanism and the subsequent clockwise rotation for re-establishing the correct display of the time are affected at a rapid rate corresponding to a specific number of turns of the moving body of the minutes.

9. A watch according to claim 8, wherein the specific number of turns of the moving body of the minutes in an anti-clockwise direction and in a clockwise direction is six.

* * * * *